United States Patent [19]

Glucksman

[11] 4,236,063

[45] Nov. 25, 1980

[54] DEHYDRATOR

[76] Inventor: Dov Z. Glucksman, 43 Norwood Ave., Newton, Mass. 02159

[21] Appl. No.: 917,967

[22] Filed: Jun. 22, 1978

Related U.S. Application Data

[63] Continuation of Ser. No. 766,771, Feb. 8, 1977, abandoned.

[51] Int. Cl.[2] ..... F26B 21/06

[52] U.S. Cl. ..... 219/400; 34/196; 34/238; 126/21 A; 219/386

[58] Field of Search ..... 219/386, 390, 400, 402, 219/387; 126/21 A, 21 R, 275 A, 275 R; 34/195–197, 200, 201, 215, 210, 211, 212, 237, 238; 416/177–179, 192, 181, 184; 312/284, 285, 236; 119/43

[56] References Cited

U.S. PATENT DOCUMENTS

| | | | |
|---|---|---|---|
| 284,922 | 11/1883 | Stutzman | 34/238 |
| 285,018 | 9/1883 | Cullen | 34/237 |
| 556,912 | 3/1896 | Amos | 34/200 |
| 629,121 | 7/1899 | Bicalky | 416/184 |
| 749,404 | 1/1904 | Smith | 34/238 |
| 1,154,927 | 9/1915 | Kate | 119/43 |
| 1,868,857 | 7/1932 | Sturgis | 119/43 |
| 1,919,970 | 7/1933 | Woods | 416/184 |
| 1,943,575 | 1/1934 | Abendroth | 219/386 |
| 2,364,722 | 12/1944 | Kazantzeff | 34/196 |
| 2,456,481 | 12/1948 | Ballantyne et al. | 34/238 |
| 3,261,343 | 7/1966 | Tibell | 126/21 A |
| 4,052,589 | 10/1977 | Wyatt | 219/400 |

FOREIGN PATENT DOCUMENTS

| | | | |
|---|---|---|---|
| 325620 | 9/1918 | Fed. Rep. of Germany | 34/237 |
| 2007213 | 1/1970 | France | 34/210 |
| 565573 | of 1957 | Italy | 34/211 |
| 416157 | 9/1934 | United Kingdom | 219/400 |

*Primary Examiner*—Roy N. Envall, Jr.
*Assistant Examiner*—Bernard Roskoski
*Attorney, Agent, or Firm*—John S. Roberts, Jr.

[57] ABSTRACT

An electrically operated dehydrator in the form of perforated trays stacked one on top of the other where the bottom tray is equipped with a blower-heater package and the top tray forms a solid cover. Air is drawn in by the blower from underneath the bottom tray, it is heated and then forced to rise through the perforated trays. A portion of the air is being recirculated into the blower through a central duct whereas the remainder of the air is allowed to bleed-out through a series of openings in the top.

8 Claims, 4 Drawing Figures

DEHYDRATOR

This is a continuation of application Ser. No. 766,771, filed Feb. 8, 1977 now abandoned.

BACKGROUND OF THE INVENTION

Drying of foodstuff for conserving it for lean periods has been in use since times immemorial. Up to modern times, such drying was done by exposing fruit, vegetables, fish or meat to the sun heat, which served to evaporate the water contained in the material and to leave a dehydrated food which could be re-conditioned by immersion in water or by cooking, or could be eaten in its dry state. Dried prunes, apples and other fruit and vegetables are nowadays high on the consumers' list, while stockfish and dried meatstrips were in common use in former times, but are now the custom in primitive societies only.

Dehydration of fruit and vegetables has, in modern times, been fully industrialized, and various methods are being used to expel the water while permitting the restoration of taste and form after re-conditioning by immersion or cooking.

It is obvious that the price of commercially dehydrated food is much higher than that of the fresh product, and it is, therefore, the object of the present invention to provide a simple domestic dehydrator which will enable a housewife to buy large quantities of foodstuff during the season and to dry it in her home for storage and future consumption.

Several different designs for dehydrators have been proposed during the past years. All such designs typically embody a casing made of wood, metal or cardboard, an array of trays mostly consisting of a screen in a metal frame and a heating element, and a blower or fan for circulating the heat through the cabinet. These existing designs are generally big, heavy and expensive to produce. Air distribution is generally poor, resulting in uneven dehydration throughout the cabinet. Most existing units comprise a heater of over 1000 watt capacity which results in energy consumption; furthermore, such high capacity heaters require acurate temperature control devices which add to the cost of the device.

SUMMARY OF THE INVENTION AND OBJECTS OF THE INVENTION

The invention consists of a domestic, electrically operated dehydrator for foodstuff in the form of a vertical column, comprising:

a motor-driven, double-inlet centrifugal blower mounted on a vertical shaft, the upper inlet of which is pneumatically connected to the top of the dehydrator by duct means and adapted to draw recirculated air into the blower impeller, while the lower inlet is pneumatically connected to the outside of the dehydrator and adapted to draw fresh air into the devce, an electric heating element surrounding the impeller circumference, a dehydrator base containing the blower, the electric motor and the heating element, consisting of an outer-casing divided by a horizontal partition into an upper space containing the blower and the heating element, and into a lower space provided with opening to the outside for admission of fresh air, the said partition being perforated coaxially with the impeller, the perforation forming the lower inlet to the blower, at least one tray adapted to be positioned on top of the said base and to be tightly connected thereto, comprising a perforated bottom supporting the food, an outer rim conforming in shape to the casing of the base, and a central duct of substantially the same height as the rim, centrally penetrating the bottom and forming a portion of the duct means connecting the inlet of the blower to the top of the dehydrator, a cover adapted to tightly close the tray along its rim, provided with vapor escape openings.

In a preferred embodiment of the invention a dehydrator is provided with two or more identical trays to be superimposed on the base and one on top of the other respectively, the said cover closing the uppermost tray.

In another preferred embodiment the base and the trays are cylindrical of identical daimeter, and are connected to each other by means of circumferential lap joints.

In still another preferred embodiment the base and the trays are rectangular in shape.

With the foregoing in mind it is a primary object of this invention to provide a novel design where a plurality of dehydrator trays are stacked one on top of each other to form the dehydrator cabinet.

It is another object of this invention to provide a design of a dehydrator which can be mass produced by injection molding the trays, thus substantially reducing the cost of the product.

A further object of the invention is to provide for an air flow pattern whereby the air is forced to pass through the perforations in every tray thereby impinging on the foodstuffs and substantially improving their drying time.

Another object of the invention is to reduce the use of energy by recirculating a portion of the air.

Still another object of the invention is to control the temperature within the dehydrator by means of an energy balance between the electric energy input and the combined energy losses through the ventilating opening in the top and through the outer walls of the dehydrator, thereby eliminating the need for a thermostat.

SHORT DESCRIPTION OF THE DRAWING

DESCRIPTION OF A PREFERRED EMBODIMENT

Figure 1:
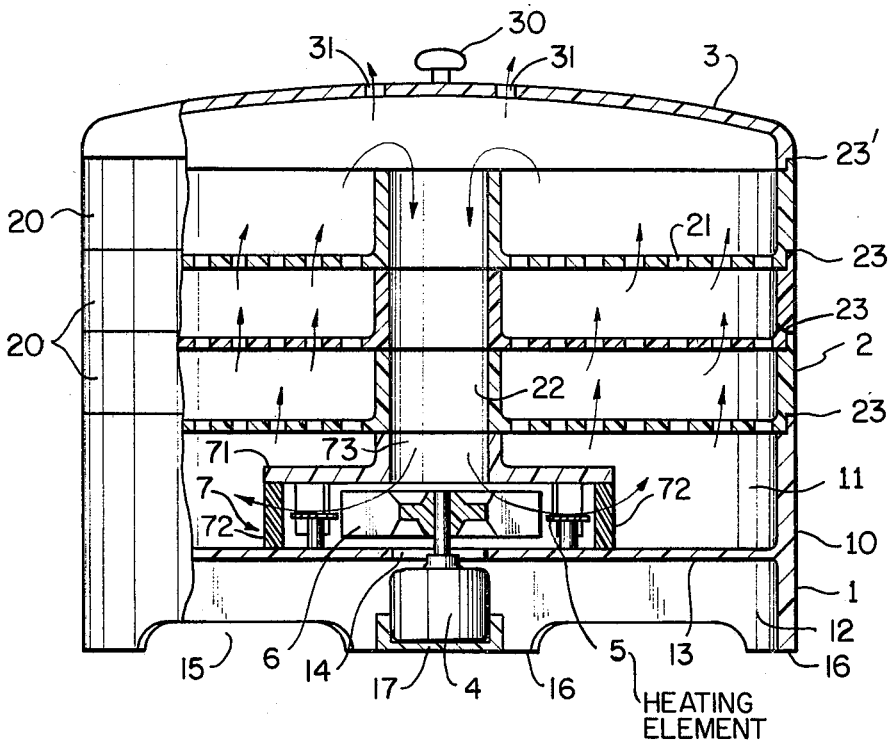
FIG. 1 is a vertical section through a dehydrator, containing three trays.

The circular dehydrator illustrated in FIG. 1 comprises a base 1, three identical, superimposed trays 2 and a cover 3, assembled with their common axis substantially vertical. The base consists of a vertical cylindrical casing 10 which is divided into an upper space 11 and a lower space 12 by a horizontal partition 13 centrally perforated by a circular air inlet 14. The lower edge of the shell is shaped to form four cut-outs 15—leaving relatively narrow legs 16 therebetween—which serve to admit fresh air to the device. Two opposite legs 16 are interconnected by a horizontal channel 17 the center of which is formed as a support for an electric fan motor 4.

Each of the trays 2 comprises a cylindrical rim 20 of a diameter corresponding to the base diameter, an annular perforated bottom 21 and a central tubular duct 22, the shell and the duct being of substantially identical height. Each tray is positioned and held in axial direction on the next lower tray or the base, respectively, by a circumferential lap joint 23. A cover 3 is similarly positioned and held on top of the uppermost tray by a lap joint 23'.

The cover is proded with a central knob 30 and vapor escape holes 31.

An electric motor 4 is positioned with its axis vertical, in the channel 17 of the base, and an impeller 6, provided with radial blades is fastened on its shaft which latter penetrates through the air inlet 14 into the upper space 11 of the base. The lower edge of the impeller is thus placed at a short distance from the upper surface of this partition. A cylindrical blower housing 7 has a cylindrical horizontal top 71 with its underside proximate the upper edge of the impeller and is supported on the partition 13 by a plurality of spaced apart ribs 72 which project downwards from the rim of the top and serve as a protecting grille against inadvertant contact with electric heating element. The top 71 is centrally perforated and continued in upward direction in the form of a cylindrical duct 73 of a diameter identical with the ducts 22 of the trays 2. An electric heating element 5 surrounds the impeller on its circumference and is clamped and positioned between the base partition 13 and the top of the blower casing 71.

Figure 2:
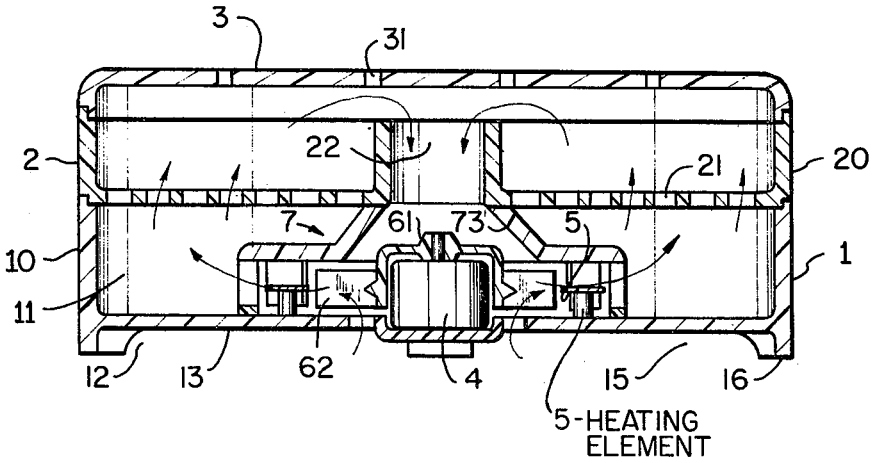
FIG. 2 is a vertical section through another embodiment of the invention, assembled with one tray only.

The dehydrator illustrated in FIG. 2 is similar to the aforedescribed embodiment, with the exception that the base is reduced in height. This is attained by providing an impeller with a dished central portion 61, lowering the center of the vanes 62 to the center of the motor circumference. By way of this arrangement the motor is located much higher in the base than in FIG. 1 permitting a lower space 12' of less height, thus reducing the total height of the dehydrator. This requires another change of dimensions, namely a wider duct mouth to accomodate the impeller; the duct is, for this reason, in the shape of a frustum 73'.

FIG. 2 shows only one tray fitted between the base and the cover, which may be suitable whenever the quantity to be dried is small.

Figure 3:
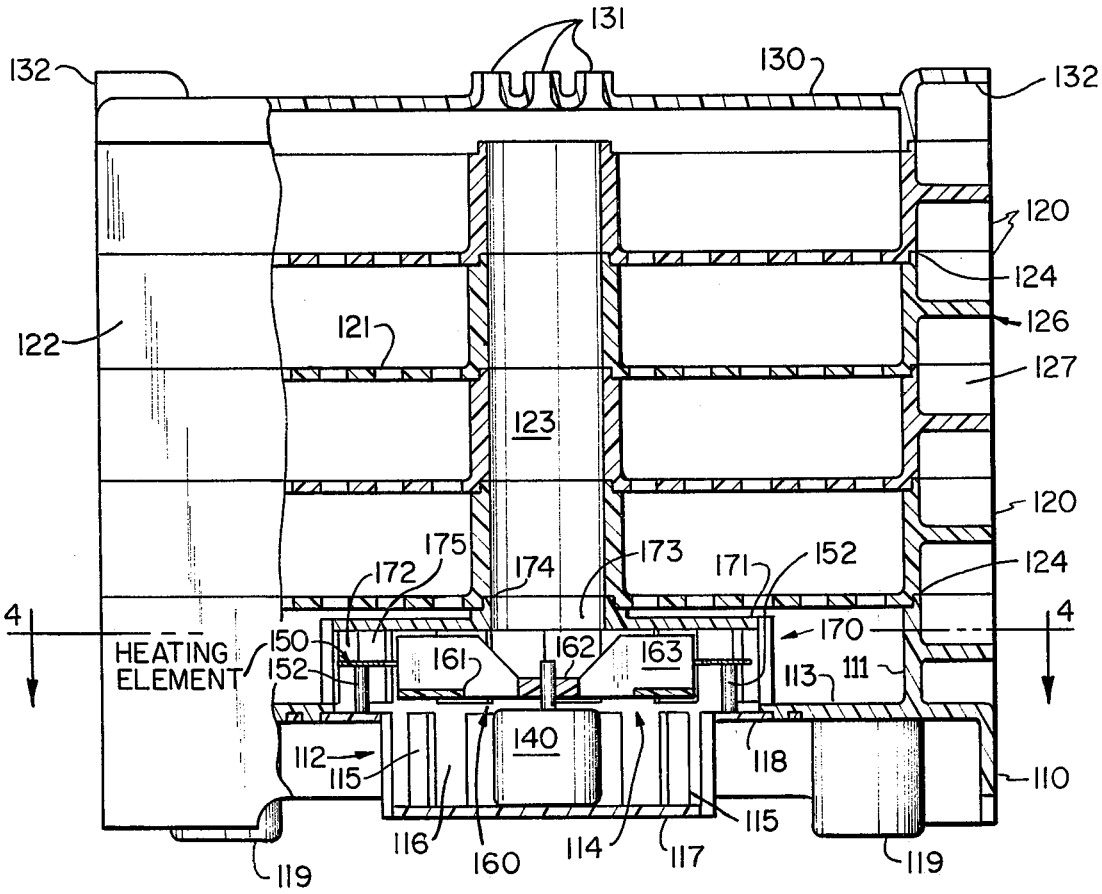
FIG. 3 is a partial vertical section through still another embodiment of the invention, rectangular in shape and containing four trays.
Figure 4:
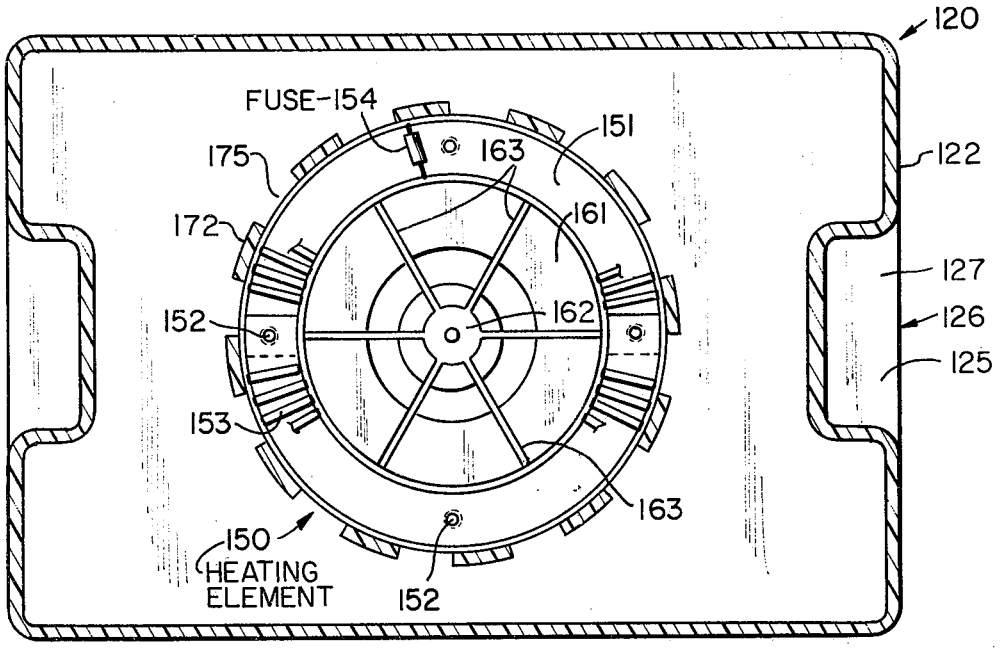
FIG. 4 is a horizontal section along lines 4—4 of FIG. 3.

The rectangular dehydrator illustrated in FIGS. 3 and 4 comprises a base 110, four identical, superimposed trays 120 and a cover 130. The base 110 consists of a vertical wall 111, a horizontal substantially rectangular plate 113. A portion of the plate 113 is molded raised to form a blower-heater enclosure 170 and four legs 119 are molded as part of the plate 113. The blower-heater enclosure 170 consists of an upper plate 171 which is open in its centre to form an air inlet duct 173 which interlocks by a lap joint detail 174 into the central tubular duct 123. To allow a free flow of air out of the blower-heater enclosure 170 yet to prevent inadvertant contact with the heater 150 the side portion of the enclosure is molded as vertical ribs 172 defining air flow passages 175.

Firmly secured to the base 110 is the blower-heater support structure 112 which encloses the motor 140, the fan 160 and the heater 150. The support structure consists of a base 117, vertical ribs 115 defining air flow passages 116 and a flange 118 which is attached to the plate 113.

The fan 160 consists of a hub 162, substantialy radial blades 163 and a ring 161 which prevents the escape of the air back into the inlet portion 114 of the enclosure 112.

The heating unit 150 consists of a mica ring 151 supported on posts 152. A resistance ribbon 153 is wound around the mica ring and a fuse 154 is fashioned so that it opens the electrical circuit in the event the heater over-heats.

The trays 120 comprise a vertical rim 122, a perforated bottom 121 and a central tubular duct 123. Each tray is positioned on top of the lower tray by peripheral lap joint 124. Each tray is provided with a handle structure 126 consisting of a recess 127 in the circumferantial wall 122 and a horizontal webbing 125.

The cover 130 is provided with a handle 132 vapor escape openings 131.

The aforedescribed embodiments are by way of example only, and modifications and alterations may be carried out to its design by a person skilled in the art.

The dehydrator is operated as follows: fruit, vegetables or other fresh foodstuff are loaded on the bottom of the trays, and in accordance with the quantity to be dried, one or two or more trays are stacked on the base. The uppermost tray is then covered by the cover which closes the dehydrator. As soon as the motor and the heating element are energized, air is expelled by the blower into the upper space of the base after having been heated by passing through the heating element. The hot air passes through the perforations in the tray bottoms and through the spaces between the separate components of the foodstuff into the space defined by the cover and the uppermost tray. During its passage through the fruit or vegetables which are suitably sliced and pared, the air absorbs a portion of its water content and becomes more humid. A small portion of the humidified air leaves the dehydrator through the openings in the cover, while the bulk of the air is sucked back into the blower through the central return duct and is recirculated after reheating. Fresh make-up air is sucked into the blower through the lower space of the base. Since specific gravity of air diminishes with increased moisture, it is the moist air which will collect at the top of the device and will be the first to escape through the holes, whilst dryer air will be recirculated. The size of these holes is sufficiently small to allow only a fraction of the circulated air to leave the dehydrator, in order not to waste heat energy. The cover may, in addition, be provided with rotatable perforated disc serving to diminish or to enlarge the air passage through the holes in accordance with its angular position.

Instead of the described heating element any other type may be placed around the impeller, such as wire coils, resistor strips or tubular elements of known design.

The radial vane impeller may be replaced by a double-inlet centrifugal impeller with curved blades, similarly mounted on the vertically positioned motor shaft in a housing of the same type as illustrated in the drawing.

What I claim is:

1. An electrically operated dehydrator for foodstuff in the shape of a stacked column, said stack comprising a base containing air recirculating and heating means, at least one perforated tray adapted to contain the material to be dried, positioned on top of said base and a top cover positioned on top of the uppermost tray wherein the respective outer covers of said base, said at least one tray and said top cover are tightly but removably connected and form the outer surface of said dehydrator, and wherein said at least one tray consists of a horizontal plate perforated by a plurality of holes, an outer frame of uniform height integral with, and surrounding said horizontal plate, and a vertical duct of preferably cylindrical shape of substantially the same height as said outer frame, and penetrating through said perforated plate in its central portion, said air-circulating and heating means comprise a double-inlet centrifugal air impeller mounted on the vertically positioned shaft of an electric motor, said impeller being positioned in a circular casing provided with air outlets distributed over the circumference of said casing and with a central inlet opening in a top portion of said casing communicating with said vertical duct in said tray, and said heating means consisting of at least one circular heating element positioned in said circular casing around the circumference of said air impeller, said dehydrator base comprising an outer frame of uniform height corresponding in cross section to the outer frame of said tray, a horizontal partition dividing said base into a lower space communicating with the outside for admission of fresh air, and into a upper space containing said circular casing, said impeller and said heating element; said partition being in its central portion provided with air inlet openings connecting said lower space with said circular casing and said impeller;

said top cover is adapted to tightly close the uppermost tray along the upper rim of its frame and providing a free space above said uppermost tray along the upper rim of its frame and providing a free space above the uppermost tray for the air flowing to said central duct in said tray, said top cover being provided with vapor escape openings in its top portion.

2. A dehydrator as defined in claim 1, wherein the base, the trays and the cover are cylindrical of identical diameter.

3. A dehydrator as defined in claim 1 wherein the base, the trays and the cover are of a substantially square horizontal section.

4. A dehydrator as defined in claim 1 wherein the base, the trays and the cover are of rectangular horizontal section.

5. A dehydrator as defined in claim 1 provided with two or more trays of identical shape.

6. A dehydrator as defined in claim 1 wherein the impeller consists of a hub with radially attached blades.

7. A dehydrator as defined in claim 1 wherein the impeller is provided with a circumferential ring on one side of its blade to prevent undesired recirculation of air into the inlet area of the blower.

8. A dehydrator as defined in claim 5 wherein the respective outer frames of said base and said trays, as well as said top cover, are connected by means of circumferential lap joints provided along their edges.

* * * * *